United States Patent [19]

Hall et al.

[11] 4,407,193

[45] Oct. 4, 1983

[54] SOLENOID IMPACT PRINT HAMMER WITH UNIFORM FREE FLIGHT TIME

[75] Inventors: David A. Hall; George P. Olson, both of Austin, Tex.

[73] Assignee: International Business Machines Corporation, Armonk, N.Y.

[21] Appl. No.: 159,702

[22] Filed: Jun. 16, 1980

[51] Int. Cl.[3] ..... B41J 7/92

[52] U.S. Cl. ..... 101/93.01; 101/93.03; 400/166; 400/157.3

[58] Field of Search ..... 101/93.03, 93.01; 400/144.2, 144.3, 157.3, 166

[56] References Cited

U.S. PATENT DOCUMENTS

| | | | |
|---|---|---|---|
| 3,712,212 | 1/1973 | Beery | 101/93 |
| 4,102,265 | 7/1978 | Deetz | 101/93.03 |
| 4,192,230 | 3/1980 | Blom et al. | 400/157.3 X |
| 4,232,975 | 11/1980 | Kane | 400/144.2 |
| 4,259,903 | 4/1981 | Arendt et al. | 101/93.03 |

FOREIGN PATENT DOCUMENTS

| | | | |
|---|---|---|---|
| 2360323 | 7/1974 | Fed. Rep. of Germany | 101/93.03 |
| 2249538 | 5/1975 | France | 101/93.03 |

OTHER PUBLICATIONS

Olson, IBM Tech. Discl. Bulletin, vol. 23, No. 1, Jun. 1980, pp. 13–14.

Kane et al., IBM Tech. Discl. Bulletin, vol. 22, No. 12, May 1980, p. 5231.

Mathews, IBM Tech. Discl. Bulletin, vol. 21, No. 12, May, 1979, p. 4763.

Mills et al., IBM Tech. Discl. Bulletin, vol. 15, No. 8, Jan. 1973, p. 2356.

*Primary Examiner*—Edward M. Coven

*Attorney, Agent, or Firm*—John W. Henderson, Jr.

[57] ABSTRACT

In an impact printer including a print wheel having a plurality of selectable character type bearing elements for respectively printing a plurality of characters, said print wheel being rotatable for selectively positioning selected type elements in successive print positions, impact means impellable against the selected elements to drive said elements against the printing medium and means for impelling the impact means against said selected type element, the present invention provides the improvement comprising the combination of means for sensing the flight time of the impelled impact means until impact by sensing variations in the velocity of said impact means, means for comparing the sensed flight time to a predetermined ideal flight time, and means for selectively varying the amplitude of the current to the impelling means to adjust the sensed flight time to equal the ideal flight time.

5 Claims, 9 Drawing Figures

SOLENOID IMPACT PRINT HAMMER WITH UNIFORM FREE FLIGHT TIME

BACKGROUND OF THE INVENTION

1. Field of the Invention

The present invention relates to impact printers and more particularly it relates to controlling the flight time of the impact means or hammer of such impact printer by controlling the amplitude of the energy to the hammer.

2. Description of Prior Art

Impact printers which utilize a print wheel, i.e., rotating disk with characters on the periphery thereof, are well known. Several of such printers are commercially available. Rotating disk printers can be divided into categories by either focusing on how the disk rotates or by focusing on how the carrier traverses.

Focusing on how the disk rotates, such printers can be divided into a first category where the disk constantly rotates and into a second category where the motion of the disk is intermittent. In printers with a constantly rotating disk, printing takes place when the hammer strikes the rotating disk. Rotation of the disk is not stopped each time a character is printed. In printers with a disk that intermittently rotates, the disk is rotated to the desired print position and then stopped. There is no disk rotation while printing takes place.

An alternate division of disk printers can be made by focusing upon the motion of the carrier. In some printers, the traverse of the carrier is stopped each time printing takes place. In other printers, the carrier is moving at the instant when printing occurs. In both the type where the carrier is moving when printing occurs and in the type where the carrier is stopped when printing occurs, the disk may or may not be rotating at the time of printing. In some printers where the carrier is moving at a fixed speed when printing takes place, the carrier is slowed down and stopped between print positions in order to give the rotating disk time to move to the desired character.

The following are some of the issued and pending patents which show rotating disk printers:

The Willcox U.S. Pat. No. 3,461,235 issued Aug. 12, 1969 shows a disk printer with a constantly rotating disk. The carrier stops at each print position.

The Ponzano U.S. Pat. No. 3,707,214, issued Dec. 26, 1972, discloses a disk printer which has separate controls for a print wheel and its carrier. The print wheel and the carrier move by the shortest distance to the next selected position. The print wheel and the carrier stop at each print position.

The Robinson U.S. Pat. No. 3,356,199, issued Dec. 5, 1967, describes a rotating disk printer wherein the disk is constantly rotating. The type elements on the disk are in a particular sprial configuration. The carrier also moves at a constant speed which is synchronized with the motion of the disk in such a manner that the desired character can be printed in each print position.

U.S. Pat. No. 4,030,591, Martin et al., issued June 21, 1977, discloses a rotating disk printer where the carrier is moving at a variety of velocities when the printing by the firing of the print hammer takes place. Thus, the firing of the print hammer must be timed dependent on the velocity of the carrier or carriage at the particular instance.

In U.S. Pat. No. 3,858,509, issued Jan. 7, 1975, a rotating disk printing apparatus is disclosed in which the striking force applied to the hammer can be varied between "light" and "hard". However, in that patent the printing is not done on-the-fly and there is no need to coordinate the speed of the carriage and the travel time of the print hammer to insure that the position of the character to be printed is at the print impact point at the time it is caused to strike the printing medium.

U.S. Pat. No. 4,035,780, L. H. Chang, issued July 12, 1977, mentions a procedure in a printer wherein upon a failure to print, at least one retry to print is made before the apparatus is stopped for an error correction routine. This patent does not involve on-the-fly printing wherein the carrier is never stopped. In the apparatus of the patent, the carrier appears to stop at each print position. Thus, it appears to be unrelated to the problem of synchronization of time related parameters in on-the-fly printers.

Further developments with rotating disk printers covered in U.S. Pat. No. 4,189,246, M. H. Kane et al., relate to rotating disk printers in which the carrier is moving at a variety of velocities, the rotatable character disk is rotating over a variety of distances and the print hammer is driven at a variety of forces in order to achieve consistent and high print quality. Thus, the approach in the Kane, et al. patent adds a further element, i.e., variable hammer force which must be coordinated with a variable carriage velocity and variable disk rotation distance in order to achieve the desired synchronization of selected printed character with the selected carrier print position. The hammer force in the Kane, et al. patent is varied by varying the duration of the current pulse used to drive the hammer.

Thus, for many advanced impact printing operations, the impact means is driven at the variety of forces each determined by the combination of the variable escapement velocity and variable hammer force required to achieve a consistent print quality with characters of different sizes. The result is that tolerances in impact means characteristics such as flight time are exceedingly close. Any minute variation in the impact means, i.e, hammer missile flight time due to wear or other minor misfunctions can seriously impede the operation of the impact printing apparatus. Also, a failure to achieve an exact coincident engagement of the missile with the selected type element on a print wheel can do serious damage to the print wheel and other parts of the printing apparatus. Consequently, it became critical in advanced printing operations that means be provided for monitoring the flight time of impelled impact means such as missiles and that further means be provided for detecting whether the required coincident engagement of the impact means with the type element had been achieved.

Any variation in missile flight time will result in a variation in the horizontal alignment of the printed character in on-the-fly printers where printing occurs with the carrier in motion. Even more significantly and irrespective of whether printing is on-the-fly, the variation of flight time will result in a change in the impact energy which will result in a poorly printed character; it may even damage the type element being struck, particularly if a relatively small character is struck with a relatively high energy. Another problem which can be highly disruptive to the operation of impact printing equipment occurs when the impact means, i.e., missile, fails to achieve coincident engagement with a selected type element on the print wheel. This can result in a bent or damaged wheel which may be hung-up on the missile. In such a situation, when the print wheel is subsequently rotated in the selection cycle, the movement can destroy the hung-up print wheel and damage the hammer mechanism.

Early attempts were made to monitor missile flight time by using impact sensing means such as contact point or piezoelectric sensing means on the printer platen or in the missile to determine the exact time of physical contact with the platen. With such approaches, by timing the period from when the missile firing pulse is initiated until contact with the platen is directly sensed, flight time may be determined. These direct contact approaches were not very practical from a commercial viewpoint. One problem was that the contact means were subject to sensing tolerances beyond what is required in the present day impact printer field. This may have been due in part to the indefiniteness of the exact point of impact which could be sensed by contact means. This was due in part to the initial contact which must be made with the print wheel and the ribbon before contact is made with the platen.

Further developments in means for sensing impact printer hammer flight and velocity covered in copending application R. H. Sweat, Jr., et al., Ser. No. 80,890 filed Oct. 1, 1979, the details of which are incorporated by reference into the description of the embodiment of the present invention, relate to means for determining the flight time of the impelled impact means by sensing velocity changes in the impact means and means responsive to the sensed flight time for controlling the impelling means to vary the energy pulse duration to the impact means. However, it has been discovered that varying the energy pulse duration to the impact means does not give consistent results. This is due to variations in the friction in impact missile bearings during free flight, after the energy pulse has ended. Therefore, the uncontrolled energy transfers during free flight of the impact missile, component tolerance variations among hammer missiles, and control circuit drift with age and temperature change result in variations in missile impact force and flight time that are not controllable by varying the energy pulse duration. Furthermore, in the Sweat, Jr. et al. application, the pulse duration is varied each time the actual impact time fails to match the predetermined impact time by a set amount. Varying the pulse duration in this fashion results in a compounding of the hammer missile to print element registration error due to the oscillation of the energy pulse width control circuit.

SUMMARY

The present invention provides an improvement in the operating characteristics and print quality control in an impact printer which includes a print wheel, impact means impellable against the print wheel to drive the print wheel against the printing medium and means for impelling said print wheel. The improvement comprises the combination of means for determining the flight time of the impelled impact means by sensing velocity changes in said impact means with means responsive to said flight time for varying the current amplitude to the impact hammer solenoid for controlling the intensity at which the hammer strikes the print wheel. By controlling the current amplitude, it becomes possible to end all hammer firing pulses at the same point in time making the flight time of the impact missile to the plate uniform and consistent irrespective of the selected one of a varying number of printing intensities. In addition, in printers having sensing means for sensing parameters such as flight time or impact intensity at the point of impact, this information can be used to make adjustments in the drive pulse so as to end the current drive pulse at the same point in time irrespective of such adjustments merely by making the adjustments in the current pulse amplitude. Additionally, tolerance levels are factored into the control function such that a past history of the difference between the predetermined impact time and the actual impact time is maintained and an adjustment to the current pulse amplitude is made only after a number of impacts occur that exceed an acceptable deviation range. This prevents random deviations from affecting the operation of the printer.

BRIEF DESCRIPTION OF THE DRAWING

Referring now to the drawing, wherein a preferred embodiment of the invention is illustrated, and wherein like reference numerals are used throughout to designate like parts.

DETAILED DESCRIPTION OF THE PREFERRED EMBODIMENT

The improvements of the present invention may be readily implemented in the apparatus described in U.S. Pat. No. 4,189,246 issued Feb. 19, 1980, which is an on-the-fly printer apparatus capable of operating at variable carriage velocities as well as variable hammer impact energy levels in accordance with the size of the characters to be printed. Consequently, if additional details of the apparatus described are needed, the subject patent is hereby incorporated into the present application by reference and should be referred to.

However, it should be recognized that the improvements of the present invention are not limited to impact printer apparatus of the specific type described in said U.S. patent. The improvement relating to the combination of sensing the flight time of the impelled missile and making adjustments in the driving current amplitude to provide a uniform flight time may be practiced in printers which do not operate on-the-fly. Likewise, the improvement may be practiced on impact printers which have only a single escapement velocity. In addition, the improvement may be practiced on apparatus in which the impact hammer or missile is driven with only a single impact energy pulse width.

Figure 1:
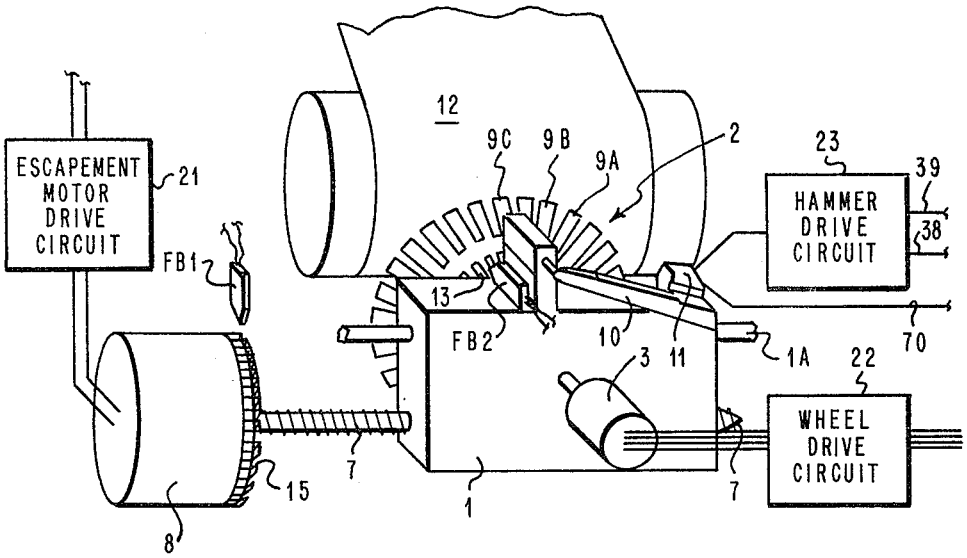
FIG. 1 shows a printer apparatus adapted for use with the present invention.

FIG. 1 shows the main mechanical components of the present printer. The components are shown somewhat schematically since they are well known and the present invention is directed to the control mechanism for the amplitude of the current pulse used to drive the print hammer 10, and not to the mechanical components per se.

As shown in FIG. 1, a laterally sliding carrier 1 is mounted on a guide rod 1*a* and a lead screw 7 and carries a rotatable print wheel or disk 2 driven by a stepping motor 3. The carrier 1 is driven by lead screw 7 which is driven by a stepping motor 8. Alternatively, motor 8 could drive a belt which in turn could drive carrier 1.

A type disk 2 comprises a disk having a number of moveable type elements such as the flexible spokes or type fingers 9*a*, 9*b*, 9*c*, etc. Printing of any desired character is brought about by operating a print hammer 10 which is actuated by a solenoid 11, both of which are mounted on carrier 1. When the appropriate type finger, 9*a*, 9*b*, 9*c*, etc., approaches the print position, solenoid 11 actuates hammer 10 into contact with the selected type finger, 9*a*, 9*b*, 9*c*, etc., driving it into contact with a paper 12 or other printing medium. An emitter wheel 13 attached to and rotating with type disk 2 cooperates with a magnetic sensor FB2 to produce a stream of emitter index pulses for controlling the operation of the printer. The emitter 13 has a series of teeth each of which corresponds to one finger 9*a*, 9*b*, 9*c*, etc. A homing pulse is generated for each rotation of the print wheel 2 by a single tooth or another emitter (not shown). The printer control can thus determine the angular position of type disk 2 at any time by counting the pulses received since the last homing pulse. A tooth emitter 15 is mounted on the shaft of the motor 8 and in conjunction with a transducer FB1 provides pulses which indicates the position of the carrier 1.

Stepper motors 3 and 8 are activated by conventional drive circuits 21 and 22. Examples of the type of drive circuitry that could be used are shown in U.S. Pat. No. 3,636,429. A hammer solenoid 11 is actuated by a hammer drive circuit 23 which is also conventional.

The actions of positioning the carrier 1 and positioning the print wheel 2 are, in general, independent except that coordination is required at the instant printing occurs. Both type disk 2 and carrier 1 must be in a selected position (but they need not be at rest) when hammer 10 strikes type disk 2.

Figure 2:
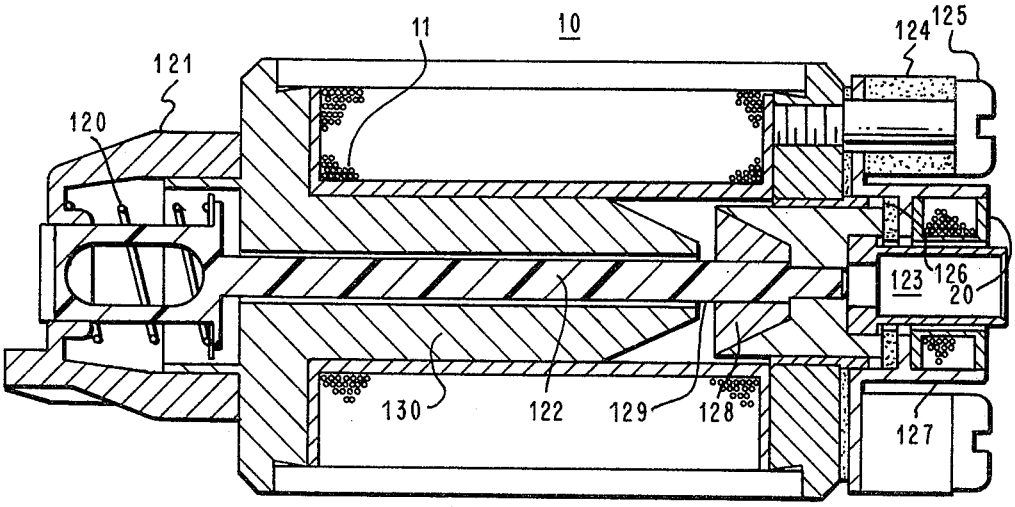
FIG. 2 is a diagrammatic partial, sectional side view of the print hammer structure of the present invention.

Referring now to FIG. 2, a more detailed drawing of the primary components of print hammer 10 is shown. The print hammer 10 includes a solenoid coil 11 wrapped about an annular metal core 130 in which is positioned a cylindrical hammer missile 122. The hammer missile 122 is supported on the left end by a teflon bearing material 121 which encloses a compression spring 120 used to return the hammer missile 122 to home position after actuation. The right end of the hammer missile 122 is attached to a metal plunger 128 which is attracted by the solenoid magnet 130 upon energization of the coil 11 to close the air gap 129. A transducer 137, composed of a permanent magnet 123 attached to the right end of the hammer missile 122 and an annular coil 20 surrounding the magnet 123, is used to sense the motion of the hammer missile 122. The time of impact of the hammer 10 is determined by the zero crossing of the induced voltage output of the sense coil 20 linked by the flux path of the permanent magnet 123 attached to the hammer missile 122. The rebound energy of the hammer missile 122 is attenuated with a dynamic damper made of elastomer pad 126 and ethylene/acrylic mounts 124 held in place by screws 125.

Figure 3:
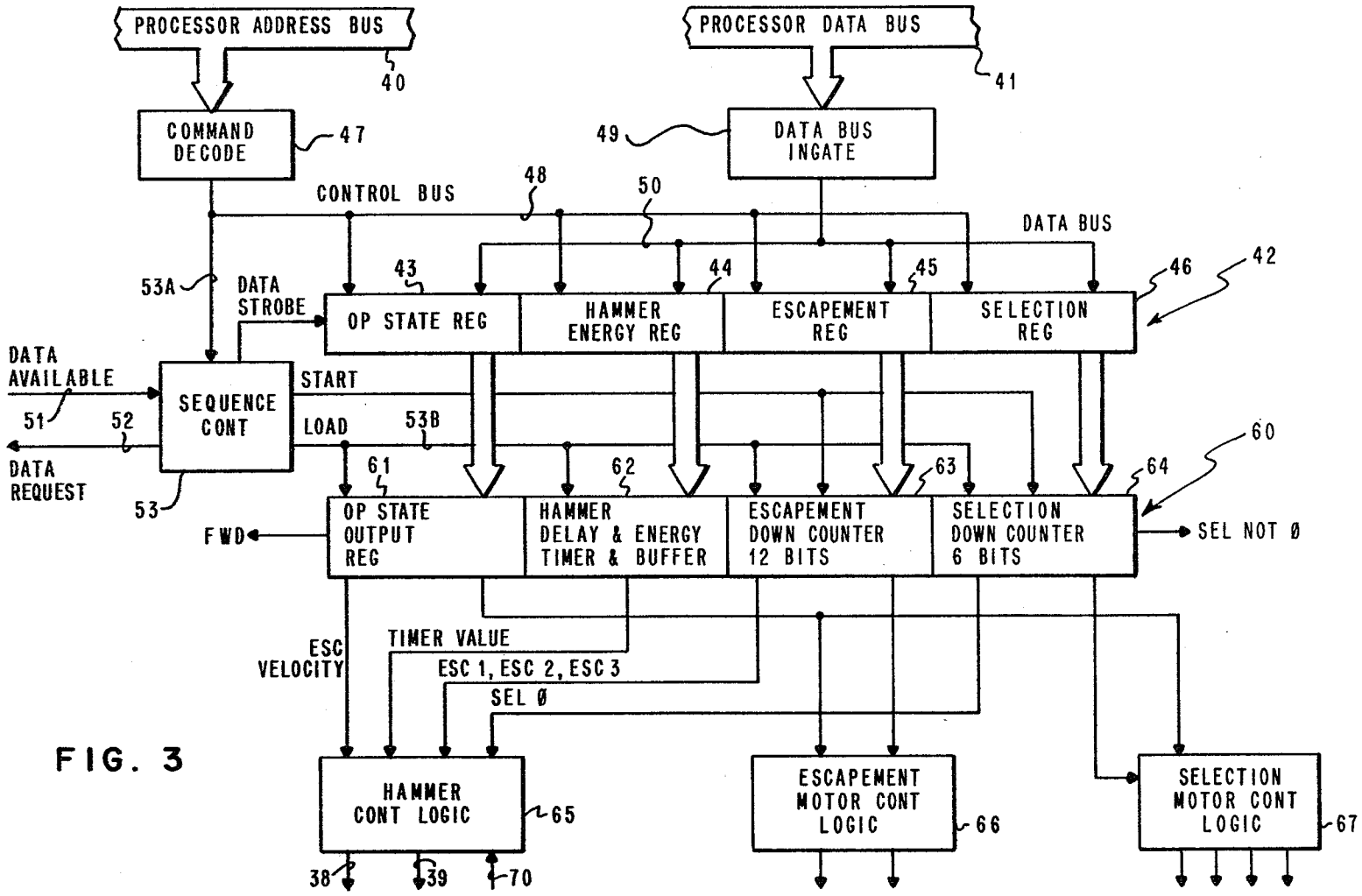
FIG. 3 is a schematic diagram, in block form, of the circuitry for controlling the operation of the motors moving the carriage and the printing disk, and of the circuitry controlling the firing of the print hammer.

Referring now to FIG. 3, a schematic diagram is illustrated of circuitry which may be utilized employing the principles of this invention discussed above in order to provide the appropriate control signals to escapement motor drive circuit 21, to print wheel drive circuit 22, and to hammer drive circuit 23. The data which is to be printed comes from a data source (not shown), which may be a conventional data buffer or keyboard input device such as a typewriter. Data from the data source is conducted to the input of a suitable computer or microprocessor, only the output of which is illustrated in FIG. 3, and the microprocessor can be any suitable commercially available microprocessor or computer such as the IBM System/7. The microprocessor receives the input data and will make certain calculations and then send a series of binary numbers out on either an address bus 40 or a data 41 as illustrated in FIG. 3. In response to the data received from the microprocessor, the circuitry shown in FIG. 3 generates appropriate drive pulses to circuits 21, 22, and 23 in order to cause stepper motors 3 and 8 to move the carrier 1 and the disk 2 to the correct positions, and to activate the print hammer 10 in order to print data supplied by the data source. The input signals to each of the drive circuits 21 and 22 include information indicating the direction which the stepper motor 3 or 8 should move, and the number of steps to be moved, it being understood that one pulse is provided by the appropriate drive circuits for each step of the motors 3 and 8.

As illustrated in FIG. 3, the circuitry of this invention includes a plurality of buffer registers indicated generally by the reference numeral 42 which receive appropriate information from the microprocessor through address bus 40 and data bus 41. As illustrated in FIG. 3, buffer registers 42 include an operating state register 43, which controls the velocity of movement of carrier 1, a hammer energy register 44 which stores data concerning initiation time and duration of the hammer energy pulse and the delay times, escapement register 45 which receives and stores data concerning the extent of movement of carrier 1, and a selection register 46 which receives and stores data from the microprocessor concerning the selection of the characters on the printing wheel 2. In order to load data into the buffer registers 42 from the microprocessor, address data from the microprocessor bus 40 is inputted into a command decode circuit 47 and from there through a control bus 48 to the respective buffer registers 42. Likewise, data from data bus 41 of the microprocessor is routed through a data bus ingate 49 and data bus 50 to the respective inputs of the buffer registers 42. The microprocessor is also connected through the control bus 48, a data available line 51, and a data request line 52 to a sequence control circuit 53 which controls the sequence of operation of the circuitry of FIG. 3 and of the microprocessor. Since printing is accomplished by the present invention while the carrier 1 is in motion, it is necessary to provide buffer registers 42 in order that data from the processor may be stored therein prior to actual usage, to permit the processor to accumulate subsequent data and to permit new data to be stored in the buffer registers 42 when the previously stored data has been dumped. In this manner, the data is available to the operating registers described below when needed in order to permit the continuous operation of the system. In addition to the buffering registers 42 described, the circuitry of FIG. 3 also includes a plurality of operating registers, illustrated generally by the reference numeral 60. In general, upon receipt of appropriate load commands, operating registers 60 receive and store the information contained in the buffer registers 42, thus permitting the buffer registers 42 to intake new data while the data in the operating registers 60 is being acted on. As illustrated in FIG. 3, an operating state output register 61 is provided to receive and store data for operating state register 43, a hammer delay and energy register 62 is provided to receive stored data received from hammer energy register 44, an escapement downcounter 63 is provided to receive and store data from escapement register 45, and a selection downcounter 64 is provided to receive and store data from a selection register 46. The outputs of the respective registers are connected as shown in FIG. 3 to hammer control logic 65 for controlling the actuation of print hammer 10, to escapement motor control logic 66 for controlling the motion of carrier 1, and to selection motor control logic 67 for controlling the motion of print wheel 2.

Figure 4:
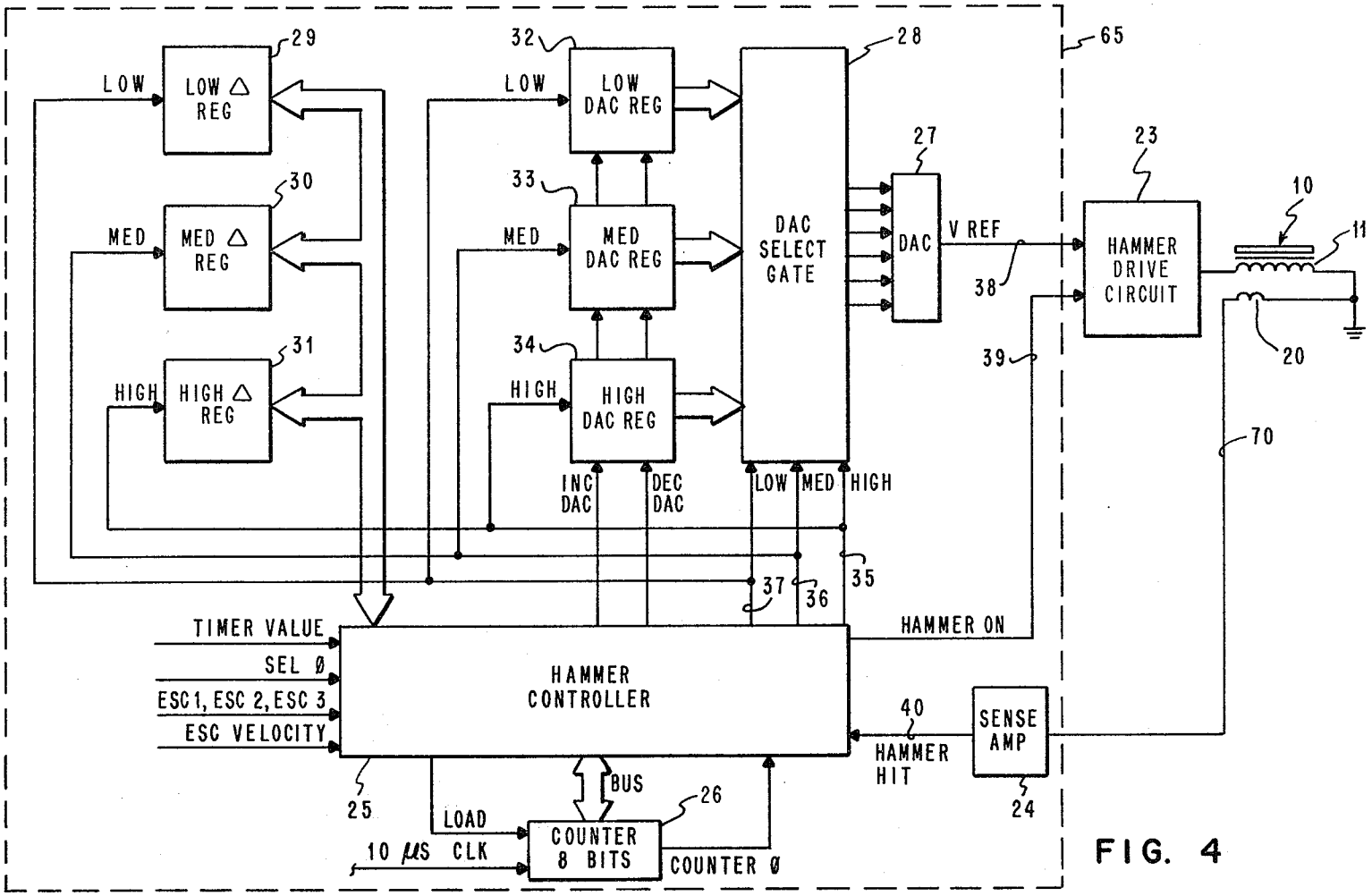
FIG. 4 is a schematic diagram primarily in block form of the logic circuitry for carrying out the flight time sensing and current pulse amplitude adjustment in accordance with the present invention.

FIG. 4 shows the basic control system for controlling the amplitude of the print hammer driving energy for providing a uniform missile flight time. The heart of the control system is the hammer controller 25 which may be a conventional microprocessor of the type previously discussed. The hammer controller 25 receives inputs from the operating registers 60 as shown by the connections to hammer control logic 65 in FIG. 3. The hammer controller 25 receives a hammer sync signal and a signal indicating which one of three current levels is required to print the next character. While this invention is shown and described using three levels of current, it will be understood that more or less than three distinct levels of current may be used depending upon the construction of the characters on the print wheel 2 and the quality of print required. The hammer sync signal and level signals are input to the hammer controller 25 from the hammer delay and energy timer buffer 62. The hammer controller 25 uses the level signal information to provide an output over line 35, 36, or 37 to the high dac register 34, medium dac register 33, or low dac register 32. This output is a digital representation of the current level to be selected for driving the print hammer 10. A signal is also provided to the dac select gate 28 to gate the contents of the selected one of registers 32, 33, or 34 to a digital to analog converter (DAC) 27. The DAC 27 converts the input digital signal to a reference voltage which is used to control the hammer drive circuit 23 over line 38. A hammer-on signal is output from the hammer controller 25 over line 39 to the hammer drive circuit 23 to gate the hammer drive circuit 23 on at the appropriate time as will be discussed in further detail below. In the preferred embodiment, the DAC 27 has six digital inputs, giving it a range of 1 to 64. The DAC 27 range corresponds to current values which are selected to be within the range of 1.8 amperes to 4.8 amperes in the preferred embodiment.

The hammer coil 11 has one end connected to the hammer drive circuit 23 and the other end connected to electrical ground. Motion of the hammer 10 induces a voltage in the sense transducer 20 which is input to the sense amplifier 24 over line 70. The output of the sense amplifier 24 is connected to the hammer controller 25 by line 40. The signal on the lead 40 is used by the hammer controller 25 to determine when the hammer 10 has driven a character on the print wheel 2 against the printing medium 12 (FIG. 1).

The hammer controller 25 also has control over the delta registers 29, 30, and 31 which store past history information on the timing used to make corrections in the current amplitudes. An external clock 26 is shown connected to the hammer controller 25 and is used for the basic timing intervals of the hammer cycle as will be discussed in more detail below.

Figure 5:
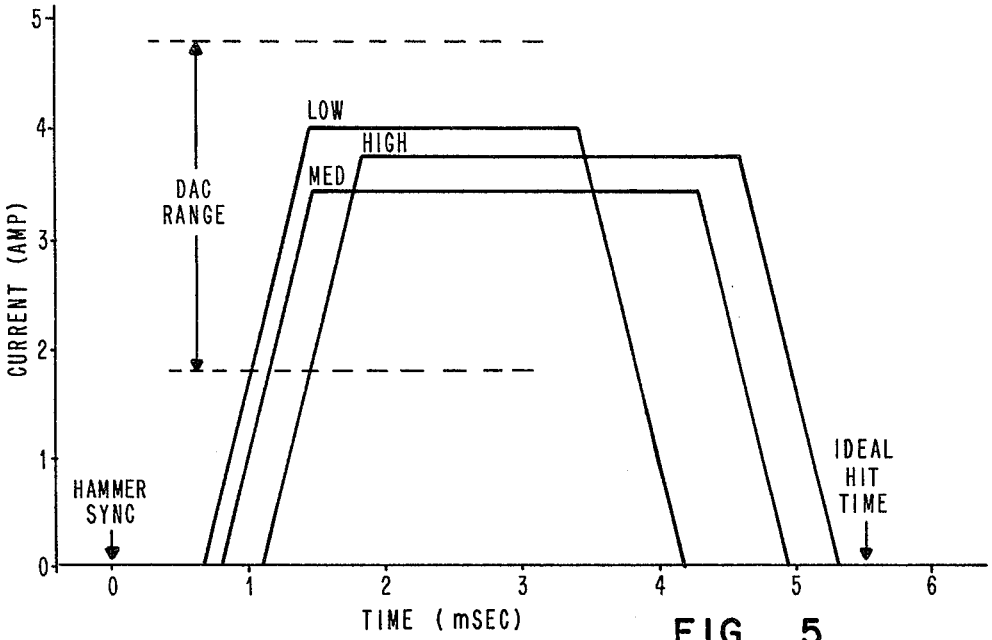
FIG. 5 is a diagram illustrating the various current pulse amplitudes utilized in this invention to control the printing hammer.

FIG. 5 shows three current profiles based on the different levels of hammer intensity. The low level turns on first and has a higher current amplitude, but the pulse width is shorter than the other two levels. If the hit, or hammer impact, occurs earlier than desired, the hammer controller 25 will reduce the dac value for that level, thereby reducing the current pulse amplitude. With a stabilized system, all levels will produce hits at approximately the same ideal time. The resulting hammer impact force will then be in the desired range.

Figure 6:
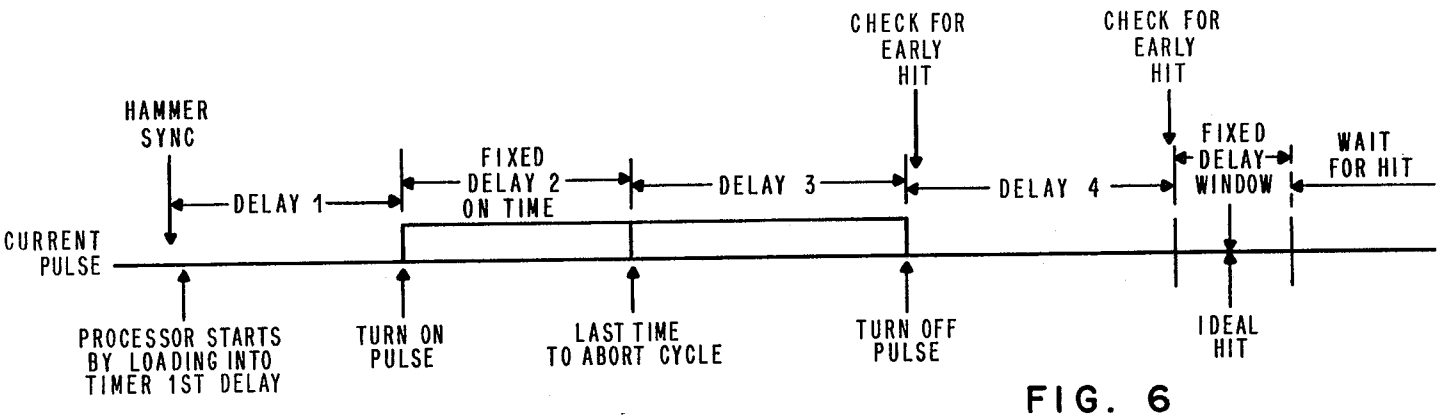
FIG. 6 is a chart showing the relationship between the various delays and current pulse widths employed to obtain a uniform flight time for the printing hammer cycle.

FIG. 6 shows the different delay times for a hammer cycle. The time from hammer sync to the ideal hit time should be constant. The hammer sync signal starts the cycle. When the hammer sync signal is received, the hammer controller 25 looks up the delays for the desired printing level. These delays are then loaded into the clock counter 26. DELAY1 is a hold-off delay used to align all target hits so that each level will hit at the same time.

DELAY2 is loaded into the clock 26 after DELAY1 times out and the gating signal is output by hammer controller 25 on line 39 to hammer drive circuit 23 to turn on the current pulse. DELAY2 is of equal duration for all levels and when it times out the hammer controller 25 checks for any signal from the rest of the system which indicates an error condition. If an error condition is present, the hammer on signal is removed, aborting the hammer cycle so that the hammer 10 will not strike the print medium 12. If no error signal is present, then the hammer controller 25 loads DELAY3 into the clock counter 26 for the remaining on-time for the current pulse. At the end of DELAY3, the hammer-on signal is turned off, turning off the current pulse and the hammer controller 25 checks the output of the sense amplifier 24 on line 40 for the proper level of the feedback signal from the sense coil 20. At this point, if the system is functioning properly, the hammer 10 should be in motion and a positive signal should be provided from the voltage induced in the sense coil 20. However, if the hit was early, the signal present on the sense amplifier 24 output line 40 will be zero or negative, indicating that the hammer 10 is at rest or rebounding following the hit.

The hammer controller 25 then loads DELAY4 into the clock counter 26 and uses DELAY4 to set up a target time window which is loaded after the feedback check for the early hit is made. If no hit has occurred, the window time delay which is the same for all levels, is loaded into the clock counter 26 and the hammer controller 25 goes into a loop checking for a hit or a time-out in the delay window. If the hit occurs, the value of the clock counter 26 is stored for the adaptive program which makes calculations for adjustments to the current pulse. If no hit occurs before time-out of the counter 26, the value in the appropriate dac register is incremented to provide a higher dac value to the DAC 27. The hammer controller 25 then waits for a hit signal and, if no hit signal occurs, an error is reported.

Figure 7:
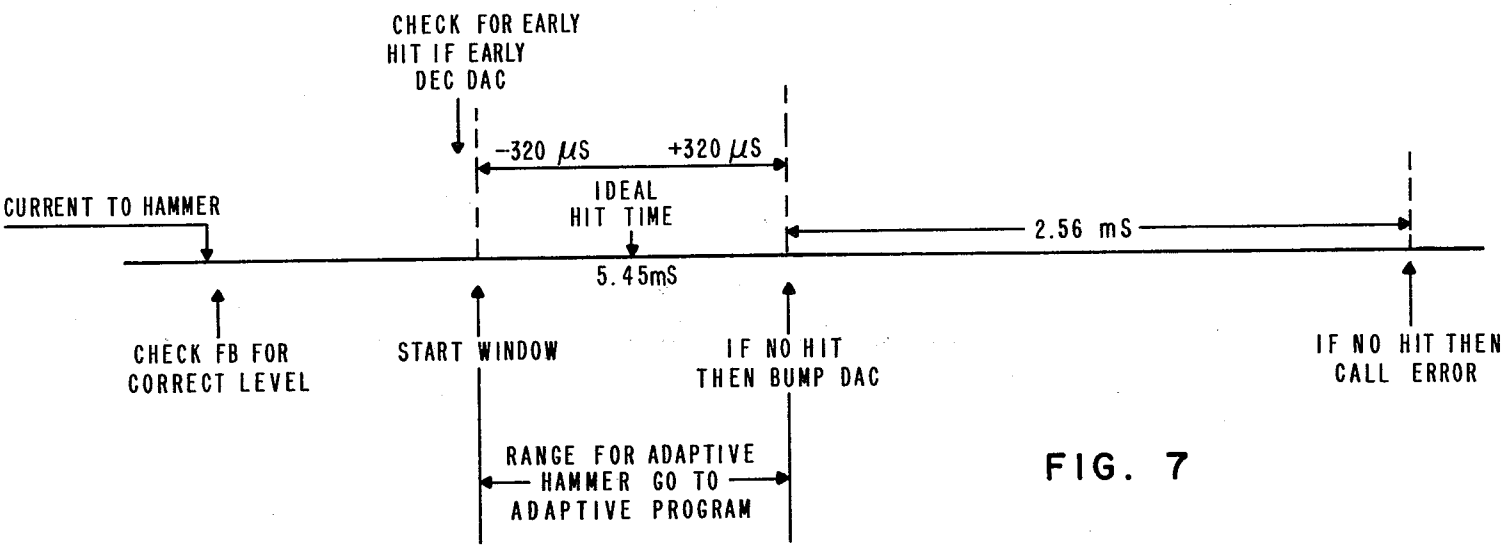
FIG. 7 is a chart showing a more detailed view of the correction time of the printing hammer cycle.

FIG. 7 shows more detail of the window time delay for correction of the hammer cycle. As was previously stated, this range is constant for all levels since the ideal hit time is the same. The figure starts at the point where the current pulse is turned off. This point varies from level to level. After the current pulse is turned off, the hammer controller 25 checks the feedback input line 40 for an early hit. If the hit has occurred before the correcting window then the dac value in the selected dac register is decremented. Otherwise, the window delay value is loaded into the clock counter 26 and the hammer controller 25 goes into a 5 microsecond loop checking for a feedback indicating that the hit has occurred or a time-out of the window delay time. If a hit occurs within the window time delay, the value of the clock counter 26 at that point is saved and is used in the adaptive program discussed below to calculate a delta value for the dac value. If no hit occurs, the dac value is incremented and the hammer controller 25 will wait 2.56 milliseconds to make sure that a late hit does occur and to delay the start of the next character selection. If no hit occurs, an error condition is reported.

Figure 8:
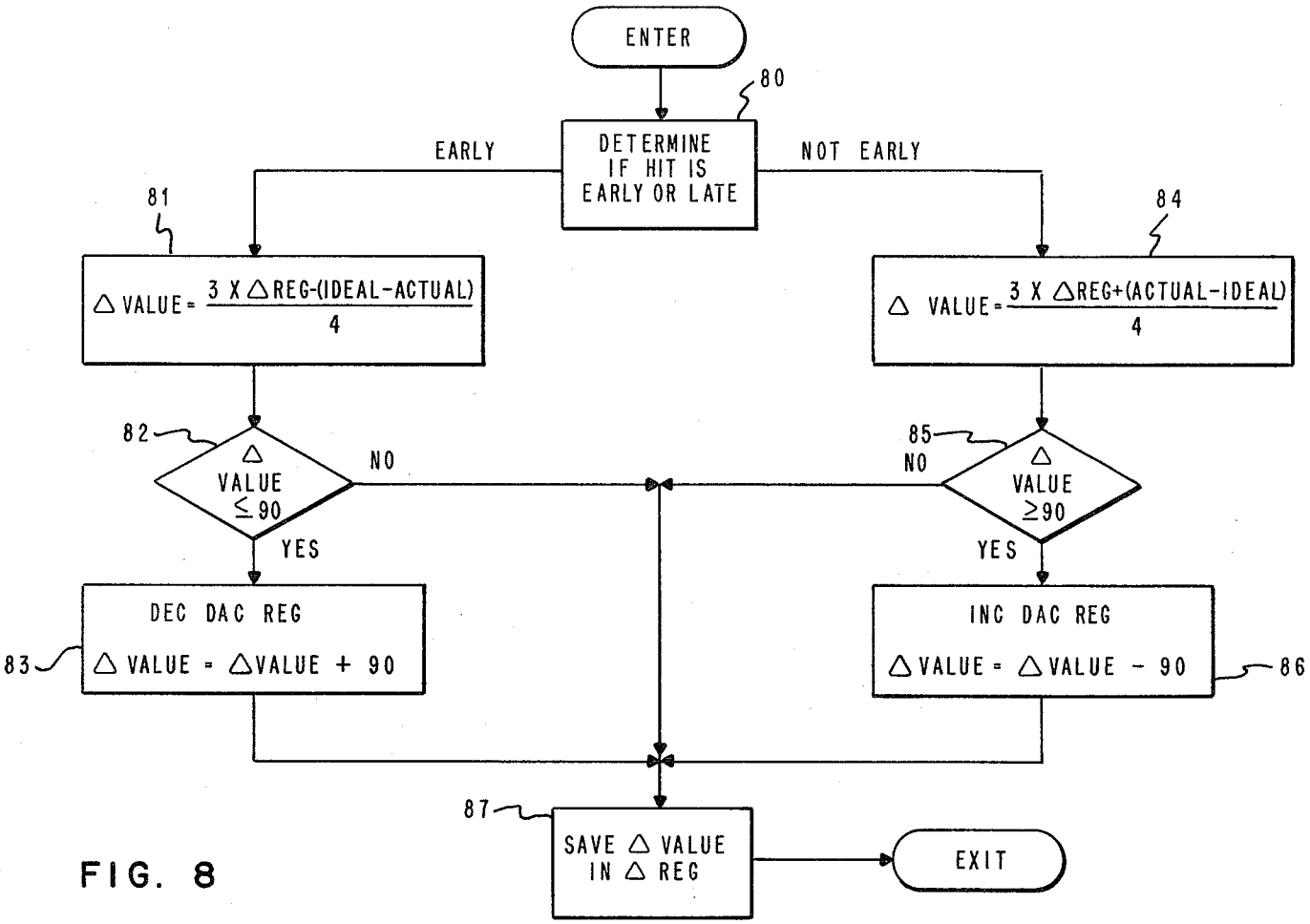
FIG. 8 is a flowchart depicting the sequence of operations carried out by the printer or control circuitry in combination with the hammer controller in the case where a flight time is being sensed and the current pulse amplitude is being adjusted.

FIG. 8 shows a simplified block diagram of the adaptive program correction routine. The clock counter value stored during the delay window is used to determine if the hit occurred before or after the ideal hit time in block 80. If the hit was late, a branch is taken to block 84. At block 84, a delta value is calculated which is 0.75 times the value in the delta register (the previous delta value) plus 0.25 times the actual hit time minus the ideal hit time (the present error). At block 85, this value is tested to see if it is larger than 90 microseconds which is the acceptable deviation from the ideal hit time. If the value is not equal to or greater than 90 microseconds, the calculated delta value is stored in the appropriate delta register, 29, 30, or 31. If the calculated delta value is 90 microseconds or more, then the appropriate dac register, 32, 33, or 34, is incremented by the hammer controller 25 and 90 microseconds is substracted from the calculated delta value. The remaining delta value is then stored in the appropriate delta register at block 87 and the hammer controller 25 is ready to accept the next printing character.

If the hit was early, then a branch is taken to block 81. At block 81 a delta value is calculated which is 0.75 times the delta register value minus 0.25 times the ideal hit time minus the actual hit time (present error). At block 82 the calculated delta value is tested to determine if it is less than or equal to 90 microseconds. If the calculated delta value is not less than or equal to 90 microseconds then the delta value is saved in the appropriate delta register at block 87. If the delta value is less than or equal to 90 microseconds, then at block 83 the appropriate dac register, 32, 33, or 34, is incremented and the delta value is increased by 90 microseconds. This delta value is then stored in the appropriate delta register 29, 30 or 31 at block 87 for use in the next iteration. The hammer controller 25 is now ready to accept the next printing character.

This hammer control technique will not change the hammer dac level unless the hammer 10 is consistently fast or slow. When the printer is initialized, the hammer control system adapts quickly if the current level is incorrect because all hits will either be early or late. Once the hammer level has been initially corrected, the hits will occur early at times and late other times and the delta values stored will tend to stay close to zero which will not allow any change of the dac current level.

Figure 9:
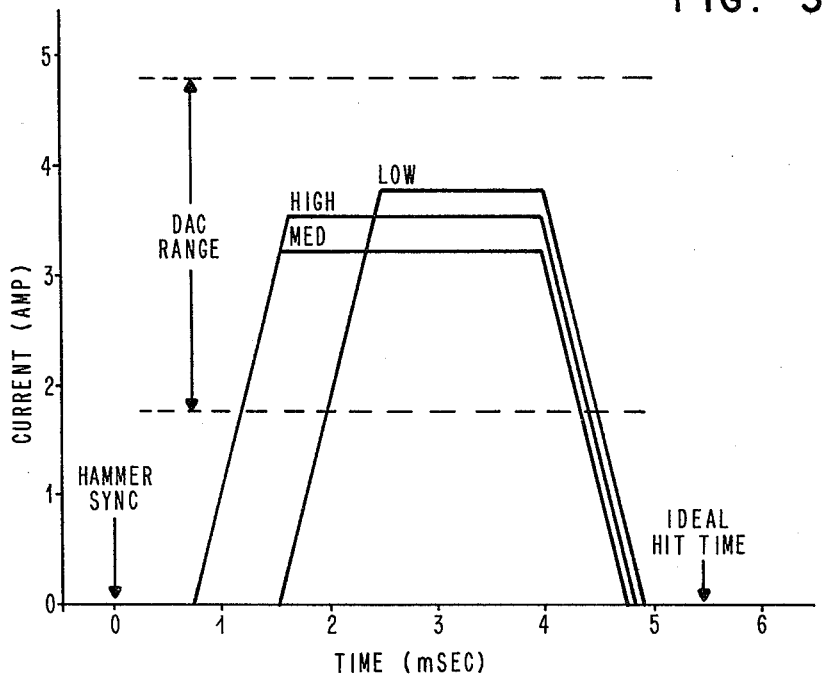
FIG. 9 is a graph showing the various current pulse amplitudes wherein a uniform free flight time is provided.

FIG. 9 shows another version of the three current levels wherein all the current pulses terminate at the same time. In this technique, not only is a uniform time provided from the hammer sync signal to the ideal hit time, but a uniform time is provided for the free flight time of the hammer from the end of the current pulse to the ideal hit time. This current pulse configuration can be produced with very little modification in the control program.

While the invention has been particularly shown and described with reference to a preferred embodiment it will be understood by those skilled in the art that various other changes in form and detail may be made without departing from the spirit and scope of the invention.

What is claimed is:

1. In an impact printer comprising means responsive to a driving signal for driving a print hammer against a print wheel to impact said print wheel against a printing medium and means for disengaging said driving means from said print hammer at a point prior to impact, the improvement comprising:

means for controlling the amplitude of the driving signal to said means for driving said print hammer against said print wheel;

means for storing a delay value representing the desired ideal time at which said print hammer should impact said printing medium;

means for sensing the actual time at which said print hammer impacts said printing medium;

means for storing a time value representing the average deviation from the ideal time at which the print hammer previously impacted said printing medium;

means for calculating a new average deviation from the ideal time based on the previous average deviation from the ideal time, the actual time and the ideal time;

means for storing a predetermined time range;

means for comparing said new average deviation from the ideal time to said predetermined time range; and means responsive to said means for comparing for adjusting said means for controlling the amplitude of said driving signal when said new average deviation from the ideal time is not within said predetermined time range.

2. The impact printer of claim 1 wherein said means for driving said print hammer is responsive to an electrical current pulse and said means for adjusting said means for controlling the amplitude of said driving signal adjusts the amplitude of said current pulse.

3. The improvement of claim 2 or claim 1 wherein said means for controlling the amplitude of the driving signal is a digital-to-analog converter.

4. In an impact printer comprising means for adjustably driving a print hammer at a selected one of a plurality of print forces against a print wheel to impact said print wheel against a printing medium, the improvement comprising:

means adapted to disengage said driving means from said print hammer prior to impact at a point from which the free flight time of the hammer from disengagement to said impact is identical irrespective the print force selected.

5. A method for controlling the intensity with which a print hammer responsive to a driving signal drives a print character against a print medium in an impact printer comprising the steps of:

(a) storing a delay value representing the ideal time at which said print hammer should impact said print medium after application of said driving signal to said print hammer;

(b) sensing the actual time at which said print hammer impacts said print medium;

(c) accumulating an average deviation from the ideal time at which the print hammer previously impacted said printing medium;

(d) calculating a new average deviation from the ideal time using the previous average deviation time, the actual time and the ideal time;

(e) storing a predetermined time range;

(f) comparing the new average deviation from the ideal time to the predetermined time range; and (g) adjusting the amplitude of the driving signal to said print hammer to appropriately increase or decrease the time at which said print hammer next impacts said print medium when said new average deviation from the ideal time is not within the predetermined time range.

* * * * *